United States Patent [19]

Diamond

[11] 4,319,421

[45] Mar. 16, 1982

[54] CEILING GRID SUSPENSION DISPLAY DEVICE

[76] Inventor: Sidney Diamond, 199 Brookville La., Glen Head, N.Y. 11545

[21] Appl. No.: 153,357

[22] Filed: May 27, 1980

[51] Int. Cl.[3] ..... G09F 7/22; G09F 7/18; B42F 13/00

[52] U.S. Cl. ..... 40/617; 248/340; 248/343; 52/39

[58] Field of Search ..... 40/617; 52/39, 484, 52/485, 486, 581; 248/339, 340, 341, 343

[56] References Cited

U.S. PATENT DOCUMENTS

| | | | |
|---|---|---|---|
| 3,004,644 | 10/1961 | Hull | 52/484 |
| 3,181,274 | 5/1965 | Izenour | 52/39 X |
| 3,918,234 | 11/1975 | Weissman | 52/39 |

*Primary Examiner*—Robert Peshock
*Assistant Examiner*—Michael J. Foycik
*Attorney, Agent, or Firm*—Howard I. Podell

[57] ABSTRACT

A portable display device in the form of an open basket of a plurality of open grid members that is detachably supported by attached flanges to the horizontal support members of a suspended panel ceiling. The basket display device, when so mounted, furnishes a support to detachable hangar devices that may suspend display merchandise, signs or other items in a store, at any desired height and above any desired floor location. The device is preferably formed as an open basket and of the general horizontal size of an individual ceiling tile of the panel ceiling, with a vertical depth ranging from one to two inches.

1 Claim, 5 Drawing Figures

CEILING GRID SUSPENSION DISPLAY DEVICE

BACKGROUND OF THE INVENTION

Many stores are fitted with suspended panel ceilings which are formed of a plurality of individual rectangular tiles, each freely supported along all four edges by support members permanetly suspended from the structure. The support members are each in the shape of an inverted T, in cross-section, with the edges of the tiles resting on the horizontal flanges of the support members. Customarily, such tiles are not otherwise fixed in place and may be readily lifted above the support members to provide access to the electrical wiring and other fixed structure that is normally concealed by the tiles. The tiles are generally formed of light-weight insulating sheet material. The structural members are generally spaced approximately two feet apart in a first direction and four feet apart in a perpendicular direction to the first direction.

SUMMARY OF THE INVENTION

My invention is a portable display device in the form of an open basket of a plurality of open grid members that is detachably supported by attached flanges to the horizontal support members of a suspended panel ceiling. The basket display device, when so mounted, furnishes a support to detachable hangar devices that may suspend display merchandise, signs or other items in a store, at any desired height and above any desired floor location. The device is preferably formed as an open basket and of the general horizontal size of an individual ceiling tile of the panel ceiling, with a vertical depth ranging from one to two inches.

By means of my invention, a store interior may be readily arranged with hanging displays of signs and merchandise at any location and may be readily rearranged so that such displays form a desired pattern in groups or lines as may be desired. When the displays are to be removed, the baskets which supported the hanging displays are readily removed without the use of any tool or fasteners.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
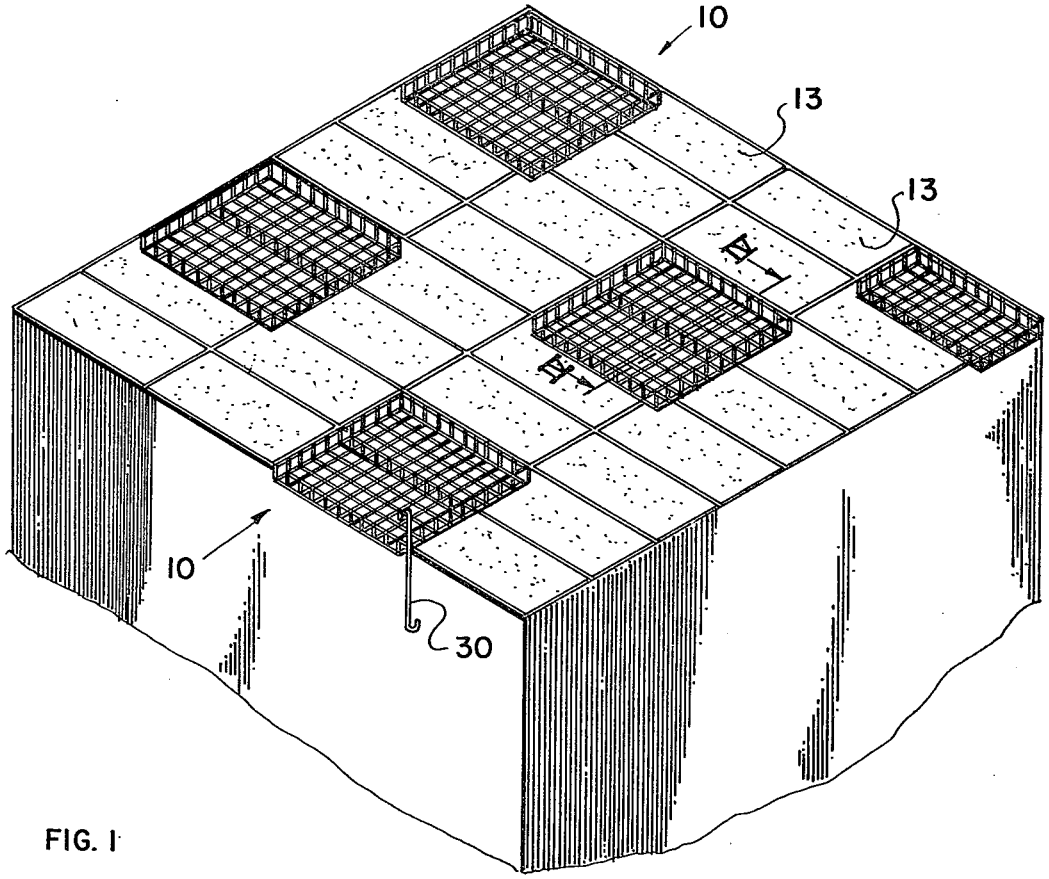
FIG. 1 is a perspective view of a store ceiling to which a plurality of baskets of the invention are detachably suspended.
Figure 2:
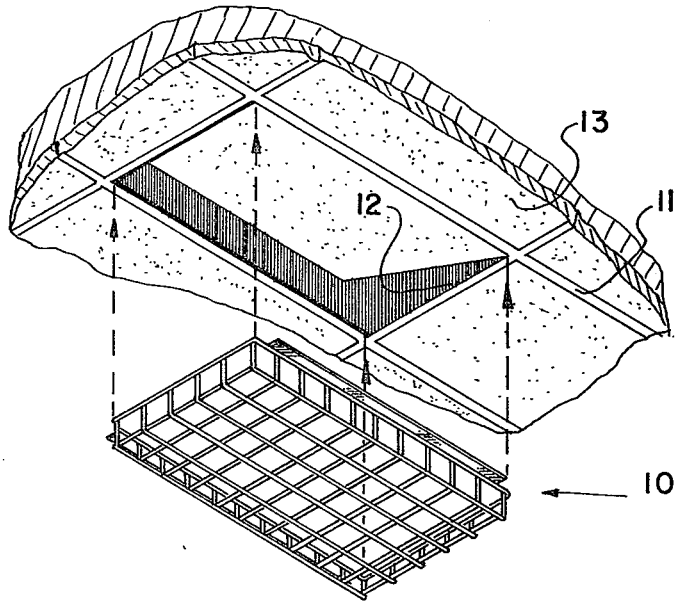
FIG. 2 is an exploded perspective view of the invention in the process of installation.
Figure 3:
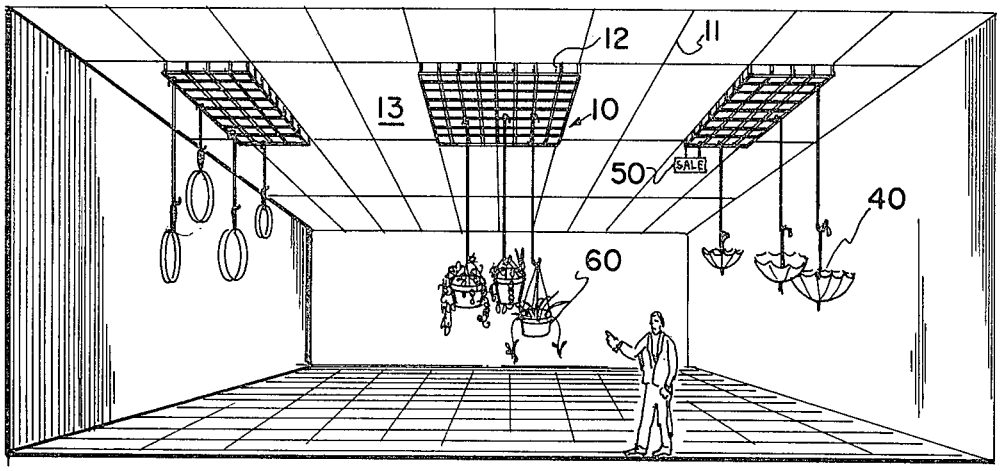
FIG. 3 is a perspective view of the invention in use.

Turning now descriptively to the drawings, in which similar reference characters denote similar elements throughout the several views, FIGS. 1–2 illustrates a conventional suspended ceiling in the interior of a store to which a plurality of display baskets 10 are detachably supported by the support members 11 and 12 which support the detachable individual ceiling tiles 13.

As shown in FIGS. 1–5, the invention is in the form of an open basket 10 formed of wire members 21 in the shape of an open grid to which wire members 21, a suspension hook 30 may be freely attached or removed, so that merchandise 40 or a sign 50 or a decorative ornament 60 may be detachably hung from lower open hook 30L with hook 30 detachably supported by upper open hook 30U to a grid member 21.

Basket 10 is formed with a peripheral upper rectangular rim 24 of a length and width similar to slightly less than the length and width of the exposed face of the tiles 13 between the support members 11 and 12 of the rectangular ceiling tile 13. Fixed to a pair of opposed sides of the rim 24 are flanges 26 which each extend away from the basket 10.

Figure 4:
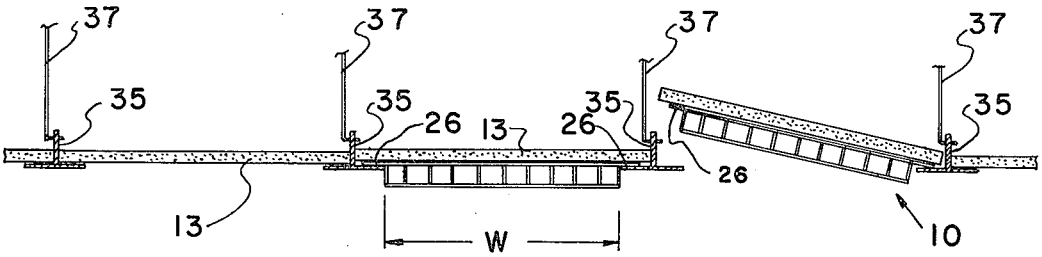
FIG. 4 is a cross-section view along lines 4—4 of FIG. 1.
Figure 5:
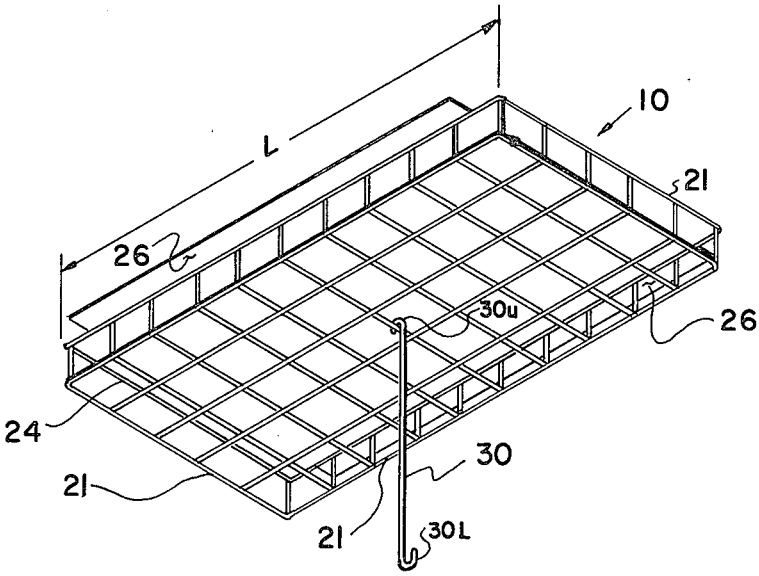
FIG. 5 is a perspective view of the invention.

As shown in FIG. 4, each support 11, 12 is in the form of an inverted T section, the upright section 35 of which is formed with a plurality of holes 36, through which wires 37 are permanently mounted to extend upwards to the fixed structure of the building (not shown) to permanently suspend the uprights 11, 12, in place.

Horizontal flange sections 38 are of a width and length to support the edges of ceiling tiles 13, with each flange 38 spaced from the flange 38 of an adjacent upright of longitudinal supports 11 and lateral supports 12 by a uniform distance which is greater than the width W of basket rim 24, or length L of basket rim 24 respectively. Flanges 26 extend over flanges 28 in the installed mode but the total width from opposed edges of basket flanges 26 is less than the spacing between a pair of upright sections 35 of adjacent longitudinal supports, so that the basket flanges 26 may freely rest on a pair of adjacent flanges 38 of adjacent supports 11 as shown in FIG. 4.

It is to be noted that rotating a ceiling tile upward, as shown in FIG. 4 permits the user to insert a basket 10 with rim 24 in a diagonal plane upward between two supports 11 and then permit the basket to drop freely downwards, with the rim 24 on a horizontal plane so that the flanges 26 of the basket rest on the flanges 38 of the supports. The ceiling tile 13 then rests above the basket so as to conceal the space above the ceiling when the basket is in place.

Removal of a basket is similarly accomplished in the reverse sequence.

While double hook hangers 30 are shown hanging from the wires of the basket 10, it may be readily understood that displayed merchandise or signs may be fixed to a basket 10 by other means or directly fastened to the basket 10.

Because the baskets 10 may be placed directly under adjacent ceiling tiles 13, bunched groups of baskets or lines of such baskets may be temporarily or permanently mounted in place as desired to create unusual varied display effects.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A portable display device formed of a size and shape to fasten between and to special laterally spaced-apart support members of a suspended tile panel ceiling, where each of said spaced-apart support members is formed with a flange upon which an edge of a ceiling tile may freely rest, said display device being formed with first means to rest on the flanges of two said adjacent laterally spaced-apart support members, and with second means to which a detachable hooked hanging member may be detachably fastened, in which said first means consist of at least one pair of spaced detent members that each extend away from each other in opposed directions and shaped so that each said detent member may rest on a flange of an individual spaced-apart support member, and in which each said detent member is fixed to a rim on the periphery of the device and shaped to extend outwardly in a direction away from the remainder of the device, in which the device is in the form of an open basket of unitary structure, said basket formed of a grid of spaced-apart and intersecting shaped wire members, which wire members serve as the second means, with the rim of said device being fixed to the basket about the periphery of said basket, and with said rim being located on an upper portion of said basket so that a lower section of the wire members extend below said rim, to form a lower portion of said basket such that in use, with the detent members resting on flanges of spaced-apart support members, edges of a ceiling tile may freely rest on the said detent members, with the lower portion of said basket extending below said ceiling tile, so as to serve as said second means with a ceiling tile in place.

* * * * *